US006939228B2

(12) United States Patent
Shimizu

(10) Patent No.: US 6,939,228 B2
(45) Date of Patent: Sep. 6, 2005

(54) GAMING MACHINE HAVING DYNAMIC BONUS FEATURE

(75) Inventor: Toshiaki Shimizu, Artarmon (AU)

(73) Assignee: Konami Gaming, Inc., Las Vegas, NV (US)

( * ) Notice: Subject to any disclaimer, the term of this patent is extended or adjusted under 35 U.S.C. 154(b) by 125 days.

(21) Appl. No.: 09/966,468

(22) Filed: Sep. 28, 2001

(65) Prior Publication Data

US 2003/0069062 A1 Apr. 10, 2003

(51) Int. Cl.[7] ..... A63F 9/24
(52) U.S. Cl. ..... 463/20; 463/25; 273/143 R
(58) Field of Search ..... 463/12–13, 16–22, 463/25–27, 30–31; 273/143 R, 138.2

(56) References Cited

U.S. PATENT DOCUMENTS 6,033,307 A * 3/2000 Vancura ..... 463/20
6,089,977 A * 7/2000 Bennett ..... 463/20
6,251,013 B1 * 6/2001 Bennett ..... 463/13
6,290,600 B1 * 9/2001 Glasson ..... 463/20
6,517,432 B1 * 2/2003 Jaffe ..... 463/16
6,634,941 B2 * 10/2003 Olive ..... 463/16

* cited by examiner

*Primary Examiner*—Mark Sager
(74) *Attorney, Agent, or Firm*—Howard & Howard

(57) ABSTRACT

A gaming machine and a method of playing the game which includes randomly displaying a plurality of game elements (20) in a grid (14) of cells (16) to produce a normal random display with one element (20) in each of the cells (16). A bonus random display of the game elements (20) is initiated in response to a triggering combination (30) of three apple symbols appearing in the cells (16). Once this occurs, a sound is played to convey the beginning of the bonus round, and the sound is preferably of bees. In the bonus round, a plurality of the cells (16) is designated as wild cells (34) for the bonus random display and a wild card (40) is positioned over the wild cell (34) such that the wild card (40) conceals the game element (20) disposed within the wild cell (34). The bonus random display is repeated for a predetermined number of rounds.

26 Claims, 7 Drawing Sheets

GAMING MACHINE HAVING DYNAMIC BONUS FEATURE

BACKGROUND OF THE INVENTION

1. Field of the Invention

The subject invention relates to a gaming machine, a method of playing the gaming machine, and a readable recording medium storing an executable control program for the game, all including a dynamic bonus feature.

2. Description of the Related Art

Various gaming machines are known in the related art to include a display having a grid of cells, such as typical slot machines. These gaming machines include a first plurality of game elements and a controller for initiating a normal random display of the game elements. A display processor is connected to the display for randomly displaying the normal random display such that one game element is displayed in each of the cells. These gaming machines also include a bonus round which is played after the normal random display and the bonus round is initiated by a triggering combination.

One such game is shown in U.S. Pat. No. 6,089,977 to Bennett wherein a machine displaying a grid of cells on a display is disclosed. A first plurality of game elements is randomly displayed within the cells in a normal random display. If a triggering combination appears within the normal random display, a bonus round is initiated. The bonus rounds freezes the game elements as displayed during the normal random display and each one of the cells is designated as wild according to a predetermined pattern. The wild moves along the predetermined pattern and forms winning combinations with the frozen game elements. However, this game only allows a user to enjoy the bonus round for those frozen game elements. If the game elements which are frozen cannot form any winning combination, then the wild does not produce the bonus aspect of the game. The bonus round may not produce a win because the frozen game elements cannot form any winning combination. Unproductive bonus rounds discourage play of the game.

Another such gaming machine and method is shown in U.S. Pat. No. 6,251,013 to Bennett. The '013 Patent discloses a gaming machine displaying a grid of cells on a display. A first plurality of game elements is randomly displayed within the cells in a normal random display. If a triggering combination appears within the normal random display, a bonus round is initiated. The bonus round includes a fairy which randomly appears and designates one of the game elements in one of the cells as wild. That specific designated game element is then wild for a predetermined number of rounds. During each of the rounds, the wild can only be utilized if the wild in the designated cell appears within any of the cells in that column. Alternately, the fairy could designate one class of elements as wild during the bonus rounds. However, these wilds during the bonus rounds can only be used if the wilds appear in the cells during the bonus rounds. Again play is discouraged when no wilds are appearing in the cells during the bonus round. When no wilds appear, the user will not be as likely to continue playing the gaming machine.

Accordingly, it would be advantageous to provide a gaming machine and method of playing a game that extends play in the bonus round by taking advantage of a wild during each of the bonus rounds. Further, it would be advantageous to provide incentive for the player to play longer.

SUMMARY OF THE INVENTION AND ADVANTAGES

The subject invention provides a gaming machine including a display having a grid of cells and a first plurality of game elements being displayed within the cells. A controller initiates a normal random display of the game elements within the cells and a display processor randomly displays the normal random display such that one game element is displayed in each of the cells. The machine is characterized by the controller being adapted to initiate a bonus random display of the game elements in response to a triggering combination of the game elements in the normal random display and to designate one of the cells in the bonus random display as a wild cell independent of the game elements in the cell.

The subject invention further provides a method of playing a game which includes the step of randomly displaying a plurality of game elements in a grid of cells to produce a normal random display with one element in each of the cells. The method is characterized by initiating a bonus random display of the game elements in response to a triggering combination of the game elements in the normal random display and designating one of the cells in the bonus random display as a wild cell independent of the game elements in that cell.

A readable recording medium storing an executable control program is also provided for randomly displaying a plurality of game elements in a grid of cells with one element in each of the cells. The control program further initiates a bonus random display of the game elements in response to a triggering combination of the game elements in the random display and designating one of the cells in the bonus random display as a wild cell independent of the game elements.

The gaming machine of the subject invention is an improvement over the related art systems. The gaming machine includes a wild cell for each of a bonus random display such that the wild cell is utilized each round thereby making the game more enjoyable to a user. Additionally, the user is more likely to continue playing the game when the wild cell is available independent of the game elements during the bonus random display.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF ONE EMBODIMENT

Referring to the Figures, wherein like numerals indicate like or corresponding parts throughout the several views, a gaming machine is shown generally at 10. The gaming machine 10 may be any slot machine having traditional reels with elements capable of performing the subject invention. However, it is preferable that the gaming machine 10 is a video slot machine.

Figure 1:
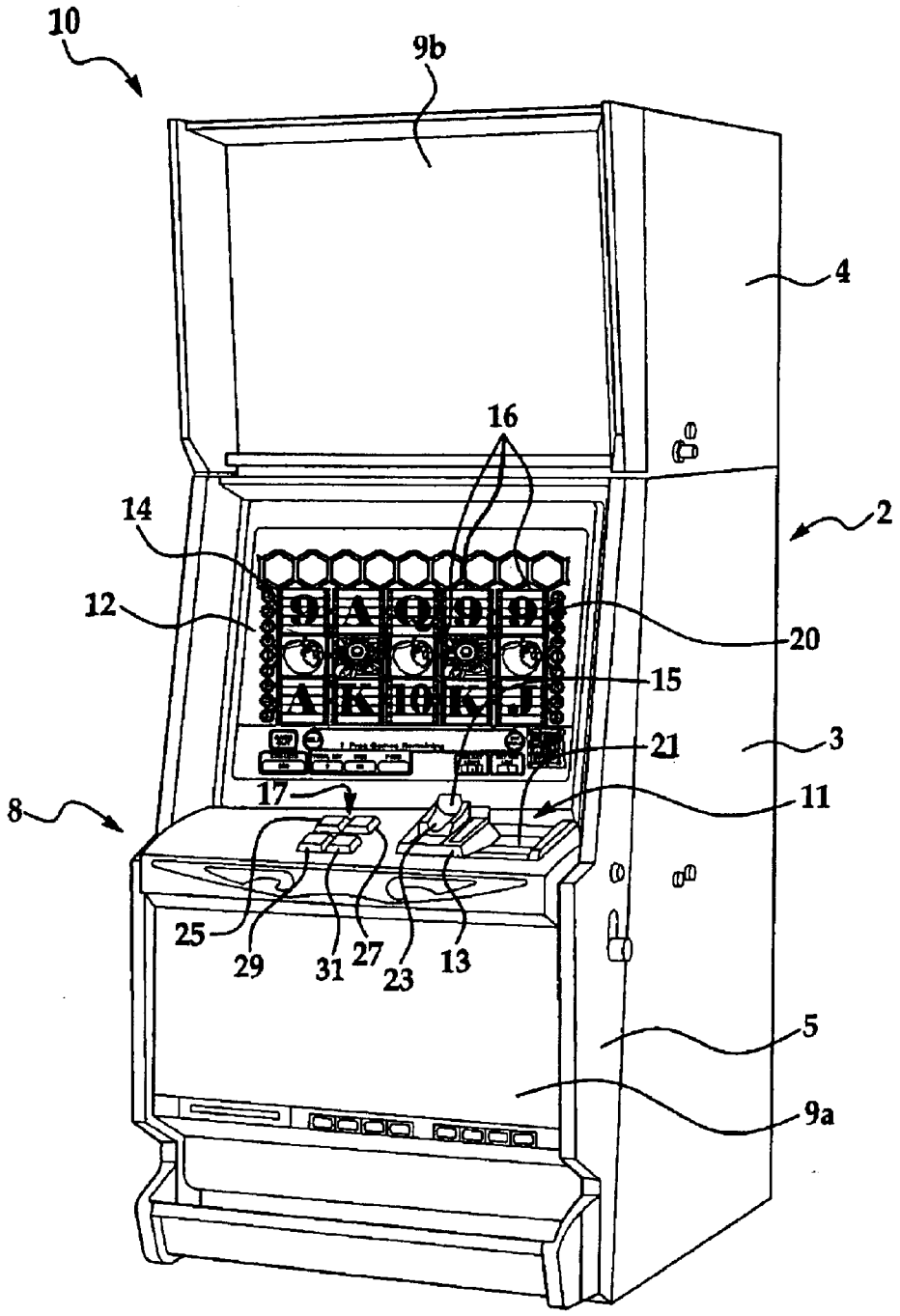
FIG. 1 is a perspective view of a gaming machine.

The gaming machine illustrated at 10 in FIG. 1 is a video gaming machine 10 into which the present invention can be incorporated to improve the enjoyment of a video game and to thereby increase the amount of time that the video game is played by patrons of a gaming establishment. FIG. 1 shows a general appearance of the video gaming machine 10 to which the present invention is applied. As shown in FIG. 1, the machine 10 comprises a housing 2 standing upright. The housing 2 comprises a main body 3, a top box 4 mounted on a top portion of the main body 3 and a door 5 attached to a front side of the main body 3 so as to be swingable between an open position and a closed position. At a center portion of the front side of the main body 3, there is mounted a main display device 12 comprising a CRT, and below the display 12 is provided an operation panel 8. The operation panel 8 is attached to the door 5 so as to slope down in a forward direction of the machine 10. Below the operation panel 8 and on a front side of the top box 4, there are provided decoration panels 9*a* and 9*b* on which pictures, letters and the like representing a title of the machine 10 or the like are illustrated.

As shown in FIG. 1, the operation panel 8 is provided, from a right end toward a left end thereof, with an insertion portion 11, and an input portion 17. The insertion portion 11 is provided with a slot base 13 integrally formed with a coin insertion portion 15 and a bill insertion portion 21. Note that the word "coin" includes coins or tokens, and the word "bill" includes bills, notes, coupons, or the like.

The input portion 17 is provided with four push button switches 25, 27, 29, 31 as first coordinate readout devices, each of which is capable of being depressed. These push button switches 25, 27, 29, 31 are selected as switches to be operated with particular high frequency during the game, so that theses switches are provided on the operation panel 8. For example, the push button switch 29 at a lower left position of the four switches is operated for starting the game. The number of the push buttons provided at the input portion 17 and functions assigned to the push buttons can be properly changed.

Figure 2:
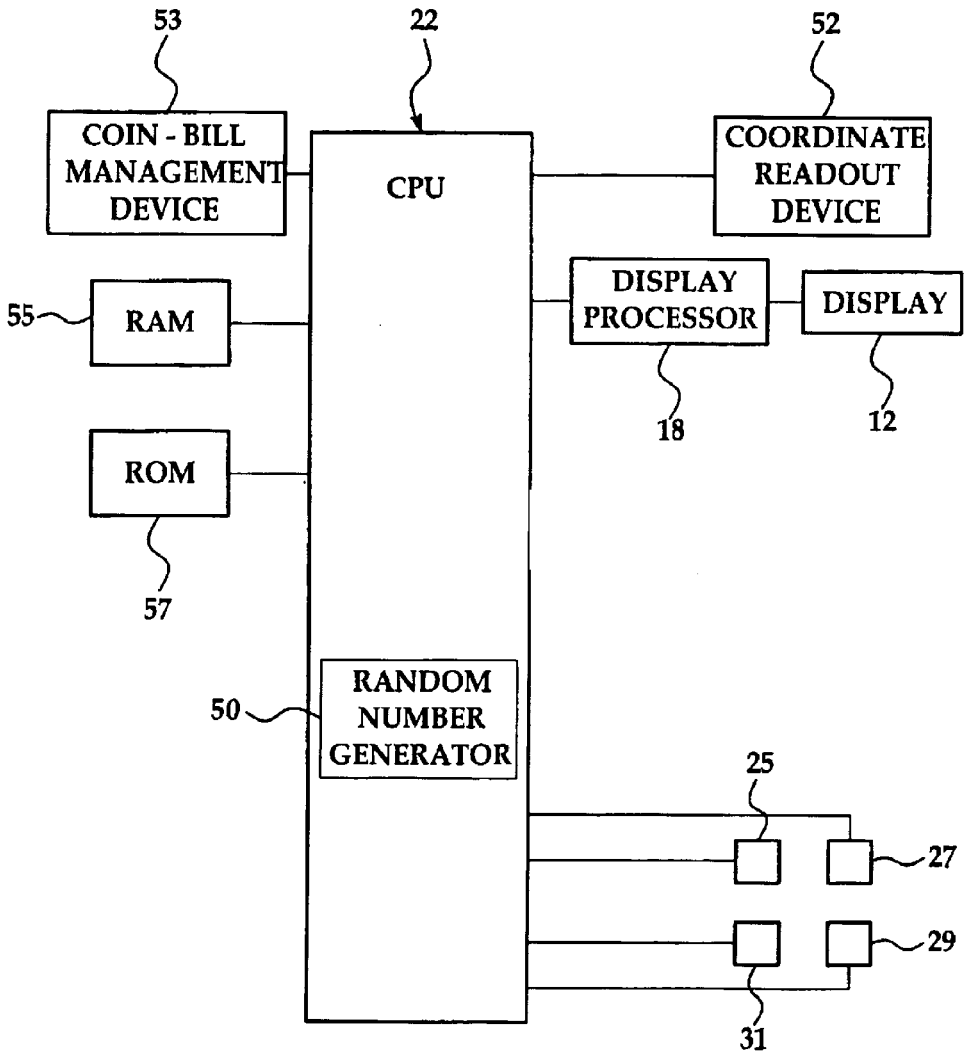
FIG. 2 is a schematic representation of the gaming machine of FIG. 1.

FIG. 2 is a block diagram illustrating a schematic configuration of a control system provided in the machine 10. The machine 10 comprises a game controller 22, or central processing unit (CPU), a coin-bill management device 53, a display processor 18, a RAM 55 as a memory device and a ROM 57 (generally provided as an EPROM). The CPU 22 is mainly composed of a microprocessor unit and performs various calculations and motion control necessary for the progress of the game. The coin-bill management device 53 detects the insertion of a coin and a bill from the coin insertion portion 15 and the bill insertion portion 21, and performs a necessary process for managing the coin and the bill. For example, the device 53 judges whether the coin and the bill are real or counterfeit, and keeps the coin and the bill judged as real while rejecting the coin and the bill judged as counterfeit. The display processor 18 interprets commands issued from the CPU 22 and displays desirable images on the display 12. The RAM 55 temporarily stores programs and data necessary for the progress of the game, and the ROM 57 stores, in advance, programs and data for controlling basic operation of the machine 10, such as the booting operation thereof, game code and graphics.

The video gaming machine 10 of FIG. 1 further includes the display 12, which, in one embodiment described herein, is advantageously a CRT type display monitor but could also be a flat panel display, LCD display, or any other display type. As will be discussed below, the display displays a simulation of a slot machine, or other game of chance, and a player using the video gaming machine 10 interacts with the simulated game.

The CPU 22 is electrically connected with a coordinate readout device 52 as well as the above mentioned push button switches 25, 27, 29, 31. The coordinate readout device 52 works as a second input device and comprises, for example, a so-called touch panel formed as a transparent panel and capable of issuing signals corresponding to the coordinates of a position touched by the player. In the CPU 22, a payment processor (not shown) is provided for counting a value of money consumed in each game.

Figure 3:
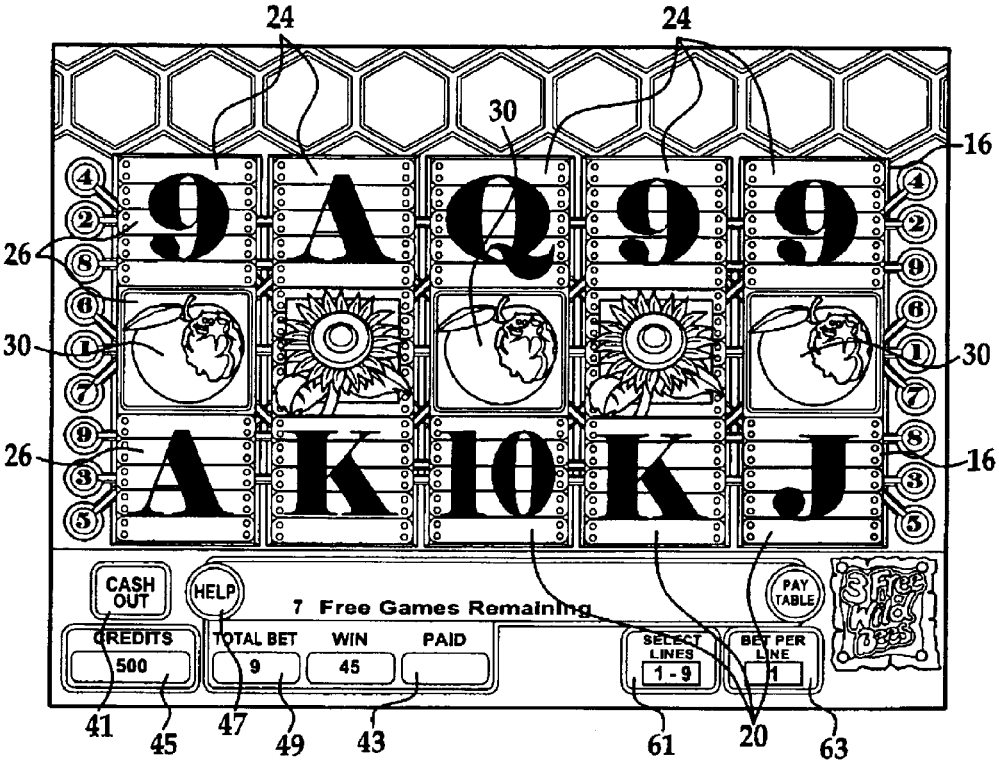
FIG. 3 is a display of a grid of cells during a normal random display having a triggering combination appearing within the cells.

Referring to FIG. 3, the controller 22 sends a signal to a display processor 18 for displaying the game elements within the cells. The display includes a cash-out touch surface 41 such that when the cash-out touch surface 41 is depressed any accumulated winnings is paid to the player. A winnings paid meter 43 keeps track of the total amount of winnings paid out to the player during a single game. A credit meter 45 is displayed for informing the player the number of credits available. The display further includes a help touch surface 47 for accessing information about the game. A select line touch surface 61 displays the number of lines selected by the player, which is preferably from one to nine lines. A bet per line touch surface 63 displays the number of credits bet per line by the player. A total bet touch surface 49 displays the total number of credits bet during a single game. For example, as shown in FIG. 3, 1 credit per line has been wagered on all nine lines for a total bet of 9 credits.

The payment processor 44 is connected to the controller 22 for awarding a regular payout in response to the game elements 20 matching the winning combination and the controller 22 also activates a bonus game in response to the game elements 20 matching the triggering combination 30 (preferably in this example, at least three apples). The regular payout varies for the amount of credits wagered. If the maximum number of credits is wagered, then the maximum regular payout is awarded for a winning combination. The controller 22 further awards a bonus award in the bonus game in response to the game elements 20 matching a winning combination.

The display 12, shown in FIG. 1, includes a grid 14 of cells 16 connected to a display processor 18. The display processor 18 randomly displays a first plurality of game elements 20 in a normal random display such that one game element 20 is displayed in each of the cells 16, as in FIG. 3. The game elements 20 are determined by a random number generator 50 before being displayed. In one embodiment, the plurality of game elements 20 includes the following symbols: 9, 10, J, Q, K, and A. Other game elements 20 used in one embodiment includes a tree symbol, a pot of honey symbol, a sunflower symbol, an apple symbol, and a statue symbol. As described above, the game elements 20 could further include a blank symbol which may also appear in the cells or other symbols as desired. The controller 22, shown in FIG. 2, is connected to the display processor 18 for initiating the normal random display of the game elements 20. The display processor 18 further displays a plurality of reels 24 and a plurality of rows 26 defining the grid 14 such that the intersection of one of the plurality of reels 24 and one of the plurality of rows 26 defines the cell 16.

The gaming machine 10 is characterized by the controller 22 initiating a bonus random display of the game elements 20 in response to a triggering combination 30 of the game elements 20 in the normal random display. The bonus random display, i.e., bonus round, occurs immediately upon the triggering combination 30 appearing in the normal random display. The triggering combination 30 includes a set of predetermined symbols being displayed in preferably at least three of the cells 16. In FIG. 3, the triggering combination 30 is shown as having three apple symbols aligned on reels 1, 3, and 5. That is, the triggering combination for the bonus round is at least 3 apples appearing in any payline wagered upon. It is to be understood that the triggering combination 30 can be different than described above while still achieving the results of the subject invention.

Figure 4:
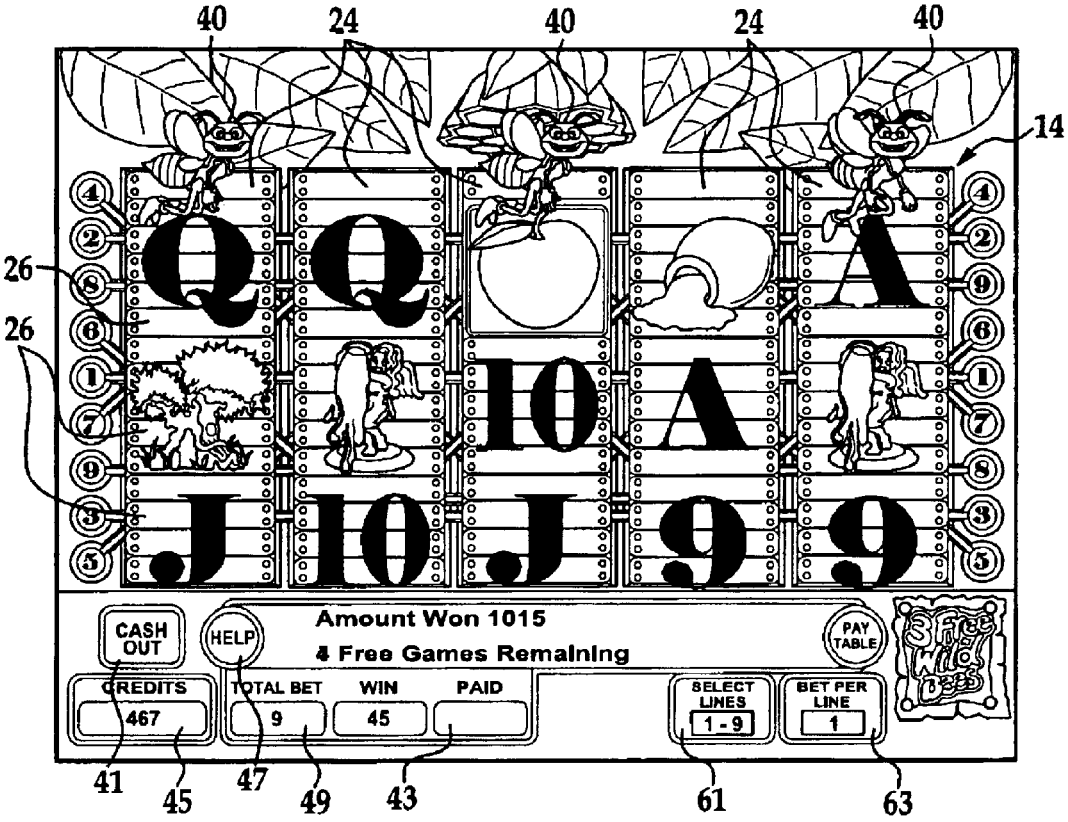
FIG. 4 is a display of the grid having a plurality of wild cards positioned about the cells.
Figure 8:
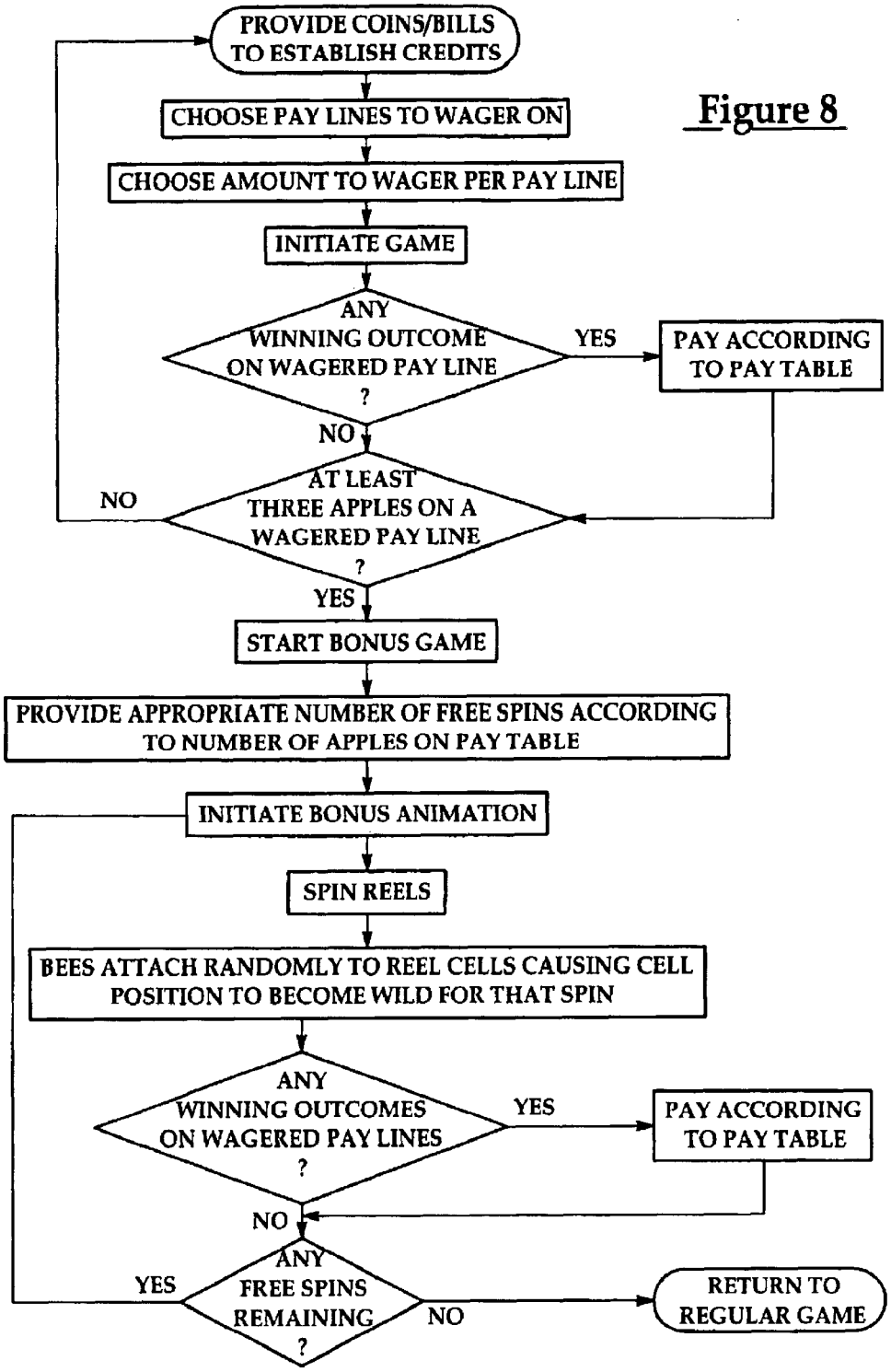
FIG. 8 is a flowchart depicting the subject invention.

The game is played by wagering credits on the desire paylines and the game is initiated. The game blocks are illustrated in FIG. 8 and described further below. The desire paylines are compared to the winning combinations and paid according to the pay table. Next, the paylines are compared to the triggering combination and if the three apples are present the bonus round is initiated. The controller 22 provides a number of free spins according to the number of apples and the pay table. A bonus animation is then activated and bonus characters e.g., three bees, fly out of a hive, as in FIG. 4, the reels spin, and the bees attach randomly to the reel cells causing the cell position to become wild for that spin. This is repeated for each of the free spins.

The controller 22 may further designate a plurality of cells 16 as wild cells 34 for the bonus random display. The controller 22 may designate up to five individual cells 16 as being wild, however, it is preferable to designate three cells 16 as wild cells 34. The three wild cells 34 can be positioned on any of the rows, but each of the wild cells 34 must be positioned on different reels 24 from one another. Furthermore, the controller 22 may position a wild card 40 over the wild cell 34 such that the wild card 40 conceals the game element 20 within the wild cell 34. Once the controller 22 designates the wild cells 34, the wild card 40 is positioned over the cell 16 prior to the game elements 20 appearing in the bonus random display, i.e., while the reels are spinning. The wild card 40 can be any symbol desired to distinguish it from the other game elements 20. The wild card 40 is preferably a bee symbol which covers the entire cell 16. The controller 22 repeats the bonus random display a predetermined number of rounds. The predetermined number of rounds relates to a number of times that the game elements 20 will be displayed during the bonus random display. For example, if the controller 22 selects the predetermined number of rounds to be seven, the bonus random display will occur seven times, which each of those seven times having the wild cells 34 in random positions.

Figure 5:
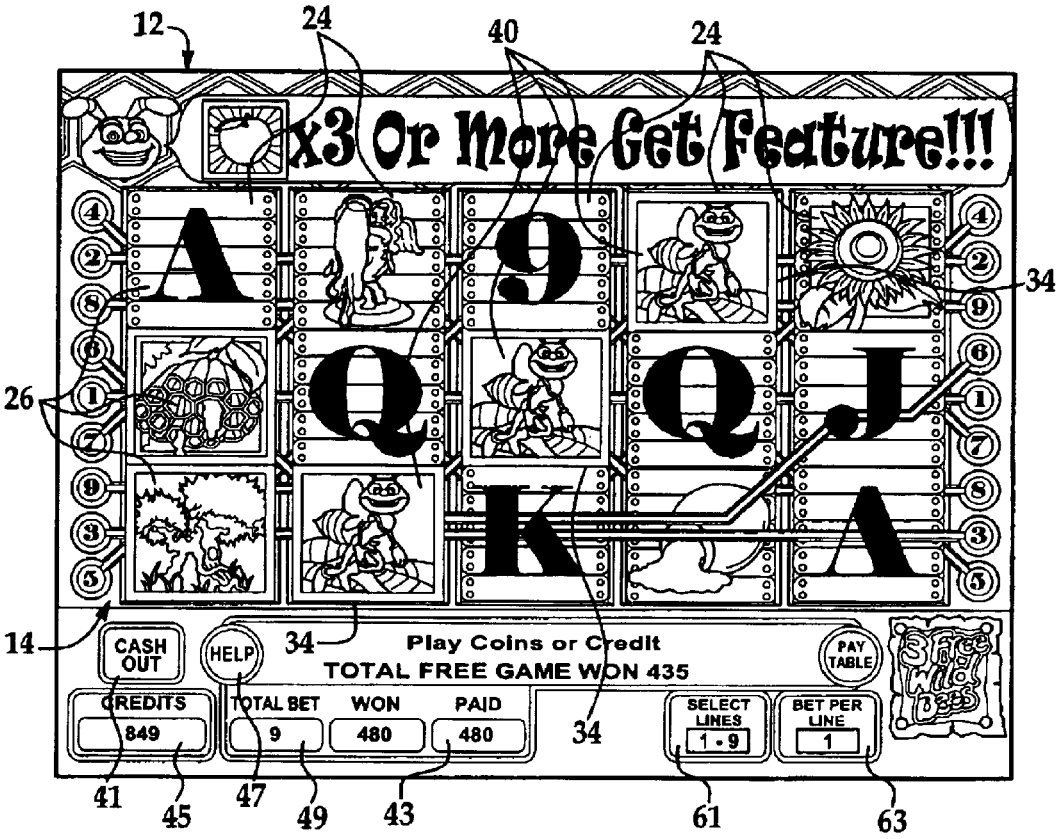
FIG. 5 is a display of the grid having wild cards positioned over the designated wild cells of FIG. 3 and having three winning combinations.

The controller 22 also displays a winning combination of the game elements 20 having at least one wild cell 34 forming the winning combination and awarding a predetermined value for the winning combination, as in FIG. 5. The winning combination in the bonus random display could be formed without any wild cell 34. There are many possible winning combinations capable of appearing within the grid 14 of cells 16. The winning combinations are typically shown in a pay table affixed to the machine for easy viewing. The pay table is stored in the EPROM and is available by touching the pay table touch surface. In the normal random display of game elements 20, winning combinations occur when the same element 20 appears, moving left to right across the reels 24, in consecutive cells 16 as described below. In the bonus random display, the wild cells 34 can form any of the winning combinations. The wild cells 34 can also form more than one winning combination, such as when the wild cell 34 is more than one symbol. For instance, the wild cell 34 can form one winning combination while being an "A", and a second winning combination while being a "9", during the same bonus random display. Hence, being designated as wild.

In one embodiment, wherein the grid 14 includes five reels 24 and three rows, there are preferably nine possible pay lines. Payline #1 is the center horizontal row as shown below:

| | | | | |
|---|---|---|---|---|
| X | X | X | X | X |

Payline #2 is the top horizontal row as shown below:

| | | | | |
|---|---|---|---|---|
| X | X | X | X | X |

Payline #3 is the bottom horizontal row as shown below:

| | | | | |
|---|---|---|---|---|
| X | X | X | X | X |

Payline #4 is a V-shaped configuration as shown below:

| | | | | |
|---|---|---|---|---|
| X | | | | X |
| | X | | X | |
| | | X | | |

Payline #5 is an inverted V-shaped configuration as shown below:

| | | | | |
|---|---|---|---|---|
| | | X | | |
| | X | | X | |
| X | | | | X |

Payline #6 is a W-shaped configuration as shown below:

| | | | | |
|---|---|---|---|---|
| X | | X | | X |
| | X | | X | |

Payline #7 is an inverted W-shaped configuration as shown below:

| | | | | |
|---|---|---|---|---|
| | X | | X | |
| X | | X | | X |

Payline #8 is another W-shaped configuration as shown below:

| | | | | |
|---|---|---|---|---|
| X | | X | | X |
| | X | | X | |

Payline #9 is another inverted W-shaped configuration as shown below:

| | | | | |
|---|---|---|---|---|
| | X | | X | |
| X | | X | | X |

These nine payline configurations are merely representative of any of a myriad of payline configurations that can be used and the number of paylines can be more or less than nine paylines. Referring to FIG. 5, the winning combination is preferably determined from left to right across the reels 24. In order to have the winning combination at least two of the same game element 20 must be on one of the paylines going from left to right and are typically illustrated on the pay table. The number of the same game elements 20 consecutively on the payline increases the total amount awarded. In FIG. 5, the designated wild cards 40 form three different winning combinations. One winning combination is in payline 3 with two tree symbols, one in payline 4 with four honeycomb symbols, and payline 6 with two honeycomb symbols. Each payline has at least one wild card in the winning combinations.

The gaming machine 10 further includes the coin-bill management device 53 for accepting credits as described above. Multiple credits may be wagered for each of the paylines. For example, three credits may be wagered for paylines #1, #2, and #3. If a winning combination results on either of these paylines, the number of credits wagered per payline multiplies the amount won. In the above example, the amount won is multiplied by three. There are certain features of the game which require the maximum credits to be wagered, such as the bonus game described above. Once the credit is input into the machine and the credits are wagered, the player touches a spin touch surface (not shown) which is read by the coordinate readout device 52 and starts the game by randomly displaying the game elements 20. Once the coordinate readout device 52 is manipulated, the controller 22 instructs the display processor 18 to display the normal random display.

Figure 6:
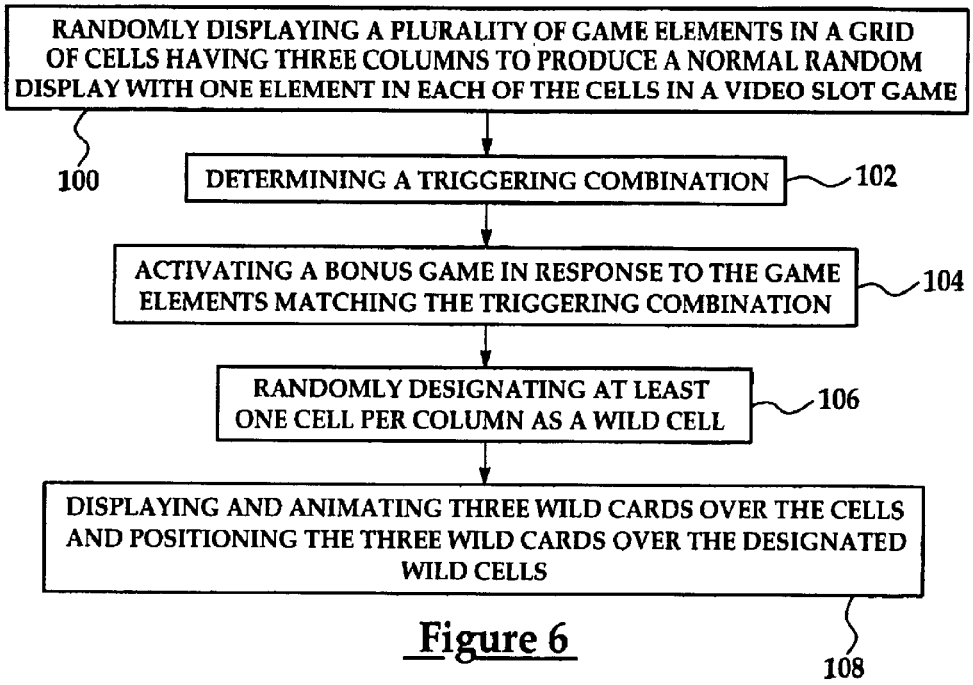
FIG. 6 is a flowchart depicting one of the methods of the subject invention.

One such method is illustrated in FIG. 6. In step 100, a plurality of game elements are randomly displayed in a grid of cells having three columns to produce a normal random display with one element in each of the cells in a video slot game. Next, in Step 102, the triggering combination is determined. In step 104, the bonus game is activated in response to the game elements matching the triggering combination. Next, at least one cell is randomly designated as a wild cell, in step 106. Finally, in step 108, three wild cards are displayed and animated over the cells and positioned over the designated wild cells.

Figure 7:
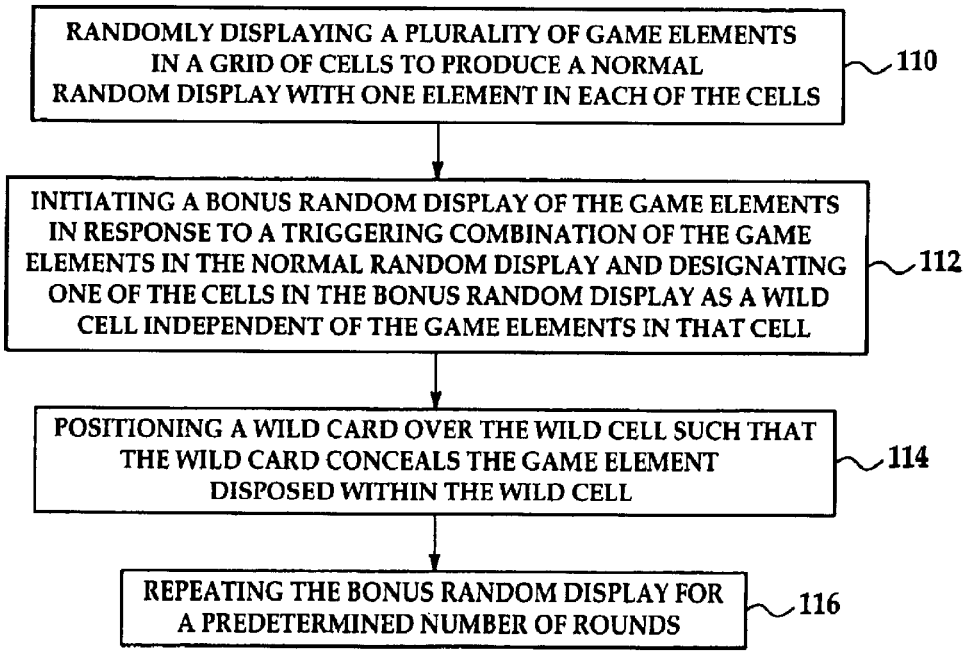
FIG. 7 is another flowchart depicting one of the methods of the subject invention.

Another method is shown in FIG. 7, which includes the step of randomly displaying a plurality of game elements in a grid of cells to produce a normal random display with one element in each of the cells in step 110. Then in step 112, a bonus random display of the game elements is initiated in response to a triggering combination of the game elements in the normal random display and one of the cells in the bonus random display is designated as a wild cell independent of the game elements in that cell. Step 114 positions wild cards over the cell such that the wild card conceals the game element disposed within the wild cell and compares the game elements to the winning combinations and awards credits accordingly. Finally, step 116 repeats the bonus random display for a predetermined number of rounds.

Many modifications and variations of the present invention are possible in light of the above teachings. The invention may be practiced otherwise than as specifically described within the scope of the appended claims.

What is claimed is:

1. A gaming machine comprising:

a display having a grid of cells;

a first plurality of game elements;

a controller for initiating a normal random display of said first plurality of game elements;

a display processor for displaying the normal random display of said first plurality of game elements such that one of said first plurality of game elements is displayed in each of said cells;

a second plurality of game elements;

said controller being programmed for initiating a bonus random display of said second plurality of game elements in response to a triggering combination of said first plurality of game elements in the normal random display;

said display processor being programmed for displaying the bonus random display of said second plurality of game elements such that the one of said first plurality of game elements displayed in each of said cells in the normal random display is replaced with one of said second plurality of game elements; and said controller being programmed for activating a bonus character to move along said grid of cells and designate at least one of said cells in said grid as a wild cell independent of a game element in said wild cell in response to initiating the bonus random display and while said first plurality of game elements are being replaced with said second plurality of game elements.

2. A machine as set forth in claim 1 wherein said controller is programmed for designating a plurality of said cells in said grid as wild cells in response to initiating the bonus random display.

3. A machine as set forth in claim 2 wherein said controller is programmed for positioning a wild card over each of said wild cells such that each of said wild cards conceals said game element within said wild cell.

4. A machine as set forth in claim 3 wherein said controller is programmed for repeating the bonus random display a predetermined number of rounds.

5. A machine as set forth in claim 4 wherein said controller is programmed for displaying a winning combination of said game elements having at least one of said wild cells forming said winning combination and awarding a predetermined value for the said winning combination.

6. A machine as set forth in claim 5 further including a coin-bill management device for receiving credit.

7. A machine as set forth in claim 6 further including a coordinate readout device for activating the game and for wagering the credit.

8. A machine as set forth in claim 1 wherein said display includes a plurality of reels and a plurality of rows defining said grid such that the intersection of one of said plurality of reels and one of said plurality of rows defines a cell.

9. A machine as set forth in claim 1 wherein the one of said first plurality of game elements displayed in one of said cells in the normal random display is the same as the one of said second plurality of game elements displayed in the same cell in the bonus random display.

10. A machine as set forth in claim 1 wherein the one of said first plurality of game elements displayed in one of said cells in the normal random display is different than the one of said second plurality of game elements displayed in the same cell in the bonus random display.

11. A method of playing a game, comprising the steps of:

randomly displaying a first plurality of game elements in a grid of cells to produce a normal random display of the first plurality of game elements with one of the first plurality of game elements being displayed in each of the cells;

determining a triggering combination;

comparing the normal random display of the first plurality of game elements with the triggering combination;

initiating a bonus random display of a second plurality of game elements in response to the first plurality of game elements matching the triggering combination;

randomly displaying the second plurality of game elements in the grid of cells to produce the bonus random display of the second plurality of game elements by replacing the one of the first plurality of game elements displayed in each of the cells with one of the second plurality of game elements;

designating at least one of the cells in the grid as a wild cell independent of a game element in the wild cell in response to initiating the bonus random display; and activating a bonus character to move along the grid of cells and designate the wild cell while the first plurality of game elements are being replaced with the second plurality of game elements.

12. A method as set forth in claim 11 further including the step of designating a plurality of the cells in the grid as wild cells in response to initiating the bonus random display.

13. A method as set forth in claim 12 further including the step of positioning a wild card over each of the wild cells such that the wild card conceals the game element disposed within each of the wild cells.

14. A method as set forth in claim 13 further including the step of repeating the bonus random display for a predetermined number of rounds.

15. A method as set forth in claim 14 further including the step of displaying a winning combination of the game elements having at least one wild cell forming the winning combination and awarding a predetermined value for the winning combination.

16. A method as set forth in claim 15 further including the step of inserting credits into a payment processor and wagering an amount of the credits.

17. A method as set forth in claim 16 further including the step of manipulating an coordinate readout device after wagering the credits for randomly displaying the game elements.

18. A method as set forth in claim 11 further including the step of displaying the grid as a plurality of reels and a plurality of rows such that the cell is the intersection of one of the reels and one of the rows.

19. A readable recording medium storing an executable control program for:

randomly displaying a first plurality of game elements in a grid of cells with one of the first plurality of game elements being displayed in each of the cells;

initiating a bonus random display of a second plurality of game elements in response to a triggering combination of the first plurality of game elements in the random display;

displaying the bonus random display by replacing the one of the first plurality of game elements displayed in each of the cells with one of the second plurality of game elements; and activating a bonus character to move along the grid of cells and designate one of the cells in the grid as a wild cell independent of the game elements in response to initiating the bonus random display and while the first plurality of game elements are being replaced with the second plurality of game elements.

20. A readable recording medium as set forth in claim 19 wherein the control program designates a plurality of the cells in the grid as wild cells in response to initiating the bonus random display.

21. A readable recording medium as set forth in claim 20 wherein the control program positions a wild card over each of the wild cells such that the wild symbol conceals the game element disposed within each of the wild cells.

22. A gaming machine comprising:

a display having a grid of cells;

a first plurality of game elements;

a controller for initiating a normal random display of said first plurality of game elements such that one of said first plurality of game elements is displayed in each of said cells;

a second plurality of game elements;

said controller being programmed for initiating a bonus random display of said second plurality of game elements in response to a triggering combination of said first plurality of game elements in the normal random display such that the one of said first plurality of game elements displayed in each of said cells in the normal random display is replaced with one of said second plurality of game elements; and said controller being programmed for activating a bonus character to move along said grid of cells and designate at least one of said cells in said grid as a wild cell independent of a game element in said wild cell in response to initiating the bonus random display and while said first plurality of game elements are being replaced with said second plurality of game elements.

23. A machine as set forth in claim 22 wherein the one of said first plurality of game elements displayed in one of said cells in the normal random display is the same as the one of said second plurality of game elements displayed in the same cell in the bonus random display.

24. A machine as set forth in claim 22 wherein the one of said first plurality of game elements displayed in one of said cells in the normal random display is different than the one of said second plurality of game elements displayed in the same cell in the bonus random display.

25. A machine as set forth in claim 22 further including a display processor in operative communication with said controller for displaying the normal random display and the bonus random display.

26. A gaming machine comprising:

a display having a grid of cells;

a first plurality of game elements;

a controller for initiating a normal random display of said first plurality of game elements such that one of said first plurality of game elements is displayed in each of said cells;

said controller being programmed for displaying a winning combination of said game elements in the normal random display and awarding a predetermined value for the winning combination;

a second plurality of game elements;

said controller being programmed for initiating a bonus random display of said second plurality of game elements in response to a triggering combination of said first plurality of game elements in the normal random display after awarding the predetermined value for the winning combination in the normal random display such that the one of said first plurality of game elements displayed in each of said cells in the normal random display is replaced with one of said second plurality of game elements;

said controller being programmed for activating a bonus character to move along said grid of cells and designate at least one of said cells in said grid as a wild cell independent of a game element in said wild cell in response to initiating the bonus random display and while said first plurality of game elements are being replaced with said second plurality of game elements; and said controller being programmed for displaying a winning combination of said second plurality of game elements having said wild cell forming the winning combination in the bonus random display and awarding a predetermined value for the winning combination in the bonus random display.

* * * * *